US010143231B2

(12) United States Patent
Poget et al.

(10) Patent No.: US 10,143,231 B2
(45) Date of Patent: Dec. 4, 2018

(54) SMOKING ARTICLE COMPRISING A BLIND COMBUSTIBLE HEAT SOURCE

(71) Applicant: Philip Morris Products S.A., Neuchatel (CH)

(72) Inventors: Laurent Edouard Poget, Bussigny (CH); Oleg Mironov, Neuchatel (CH); Stephane Roudier, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/896,589

(22) PCT Filed: Aug. 12, 2014

(86) PCT No.: PCT/EP2014/067233
§ 371 (c)(1),
(2) Date: Dec. 7, 2015

(87) PCT Pub. No.: WO2015/022317
PCT Pub. Date: Feb. 19, 2015

(65) Prior Publication Data

US 2016/0143356 A1 May 26, 2016

(30) Foreign Application Priority Data

Aug. 13, 2013 (EP) ..... 13180308

(51) Int. Cl.
*A24F 47/00* (2006.01)

(52) U.S. Cl.
CPC ..... *A24F 47/006* (2013.01)

(58) Field of Classification Search
CPC ..... A24F 47/004; A24F 47/006
See application file for complete search history.

(56) References Cited

U.S. PATENT DOCUMENTS 4,714,082 A 12/1987 Banerjee et al.
4,793,365 A * 12/1988 Sensabaugh, Jr. ... A24B 15/165 128/202.21

(Continued)

FOREIGN PATENT DOCUMENTS

CN 101778578 A 7/2010
EP 0 337 507 A2 10/1989

(Continued)

OTHER PUBLICATIONS

Office Action dated Apr. 11, 2016 in Korean Patent Application No. 10-2015-7033710 (with English language translation).

(Continued)

*Primary Examiner* — Eric Yaary
(74) *Attorney, Agent, or Firm* — Oblon, McClelland, Maier & Neustadt, L.L.P.

(57) ABSTRACT

A smoking article is provided, including a blind combustible heat source having opposed front and rear faces and having a transverse cross sectional area of at least about 60 percent of a transverse cross-sectional area of the smoking article; an aerosol-forming substrate downstream of the rear face, wherein the rear face and the aerosol-forming substrate are exposed to one another; a mouthpiece downstream of the aerosol-forming substrate; and one or more air inlets located downstream of the rear face and upstream of the mouthpiece. The one or more air inlets are located between the rear face and a downstream end of the aerosol-forming substrate and include one or more first air inlets around a periphery of the aerosol-forming substrate. Air drawn through the aerosol-forming substrate enters the smoking article through the one or more air inlets.

12 Claims, 2 Drawing Sheets

(56) References Cited

U.S. PATENT DOCUMENTS

Figure 1:
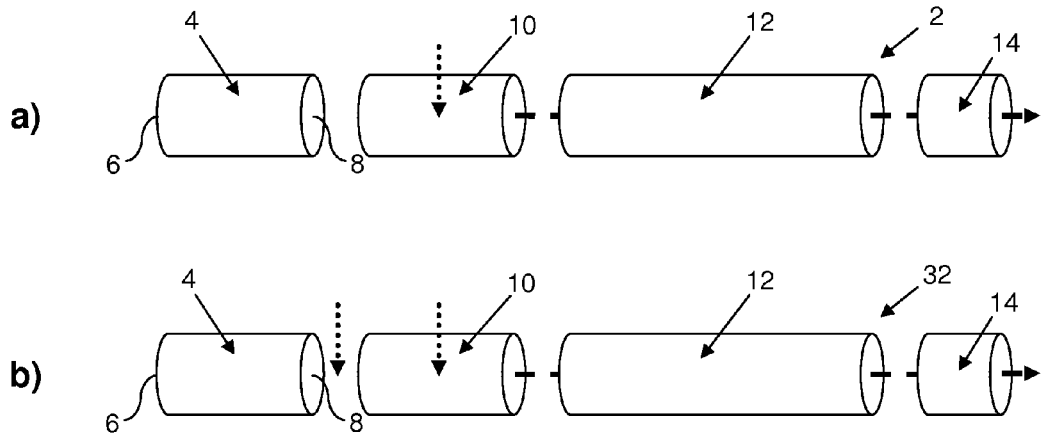

| | | | | |
|---|---|---|---|---|
| 4,924,883 | A * | 5/1990 | Perfetti | A24F 47/004 131/335 |
| 5,062,434 | A * | 11/1991 | Aulbach | A24D 1/027 131/336 |
| 5,076,292 | A | 12/1991 | Sensabaugh, Jr. et al. | |
| 6,164,287 | A * | 12/2000 | White | A24F 47/008 131/194 |
| 2003/0075188 | A1 | 4/2003 | Adiga et al. | |
| 2005/0115579 | A1* | 6/2005 | Beven | A24B 15/165 131/347 |
| 2007/0215168 | A1* | 9/2007 | Banerjee | A24B 15/165 131/335 |
| 2009/0065011 | A1* | 3/2009 | Maeder | A24F 47/006 131/194 |
| 2010/0059070 | A1* | 3/2010 | Potter | A24F 47/004 131/194 |
| 2011/0036367 | A1 | 2/2011 | Saito et al. | |
| 2011/0180082 | A1* | 7/2011 | Banerjee | A24B 15/165 131/280 |
| 2012/0067360 | A1* | 3/2012 | Conner | A24B 15/165 131/280 |
| 2013/0061861 | A1 | 3/2013 | Hearn | |
| 2013/0276803 | A1 | 10/2013 | Saito et al. | |

FOREIGN PATENT DOCUMENTS

| | | | | |
|---|---|---|---|---|
| EP | 2 289 357 | A1 | 3/2011 | |
| FR | 1.537.026 | | 8/1968 | |
| GB | 2469850 | A | 11/2010 | |
| JP | 62-224277 | A | 10/1987 | |
| JP | H03-90163 | | 4/1991 | |
| JP | 2008-35742 | A | 2/2008 | |
| JP | 2009-529871 | | 8/2009 | |
| JP | 2010-535530 | A | 11/2010 | |
| JP | 2012-502658 | | 2/2012 | |
| JP | 5178829 | B2 | 4/2013 | |
| JP | WO 2013/094681 | A1 | 6/2013 | |
| RU | 1812955 | A3 | 4/1993 | |
| RU | 2311859 | C2 | 12/2007 | |
| RU | 2389419 | C2 | 5/2010 | |
| WO | 03/034847 | A1 | 5/2003 | |
| WO | WO 2009/022232 | A2 | 2/2009 | |
| WO | WO 2009/122232 | A1 | 10/2009 | |
| WO | WO 2011117750 | A2 * | 9/2011 | A24B 15/165 |
| WO | 2011/139730 | A1 | 11/2011 | |
| WO | WO 2012/164077 | A1 | 12/2012 | |
| WO | WO 2013/043299 | A2 | 3/2013 | |
| WO | WO 2013/072336 | A1 | 5/2013 | |
| WO | WO 2013/120849 | A1 | 8/2013 | |
| WO | WO 2013/120854 | A1 | 8/2013 | |
| WO | WO 2013/120855 | A1 | 8/2013 | |

OTHER PUBLICATIONS

International Search Report and Written Opinion dated Sep. 29, 2014 in PCT/EP14/067233 Filed Aug. 12, 2014.

Office Action dated May 23, 2016 in Japanese Patent Application No. 2016-513409 (with English language translation).

Combined Office Action and Search Report dated Jun. 15, 2016 in Chinese Patent Application No. 201480033027.9 (with English language translation).

Japanese Office Action with English translation dated Dec. 26, 2016 in corresponding Japanese Patent Application No. 2016-513409, (13 pages).

Russian Decision of Grant with English translation dated Jan. 26, 2017 in corresponding Russian Patent Application No. 2015147498, (14 pages).

Office Action dated May 19, 2017 in Kazakhstan Patent Application No. 2016/0231.1 (with English language translation).

Japanese Office Action dated Sep. 25, 2017 in Patent Application No. 2016-513409 (with English Translation).

Notice of Allowance dated Nov. 6, 2017, in Korean Patent Application No. 10-2015-7033710 (with English language translation).

* cited by examiner

SMOKING ARTICLE COMPRISING A BLIND COMBUSTIBLE HEAT SOURCE

The present invention relates to a smoking article comprising a blind combustible heat source with opposed front and rear faces and an aerosol-forming substrate downstream of the rear face of the blind combustible heat source.

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate. The aerosol-forming substrate may be located within, around or downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user. Typically, air is drawn into such known heated smoking articles through one or more airflow channels provided through the combustible heat source and heat transfer from the combustible heat source to the aerosol-forming substrate occurs by forced convection and conduction.

For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate. To provide a controlled amount of forced convective heating of the aerosol-forming substrate, at least one longitudinal airflow channel is provided through the combustible heat source.

In known heated smoking articles in which heat transfer from the combustible heat source to the aerosol-forming substrate occurs primarily by forced convection, the forced convective heat transfer and hence the temperature in the aerosol-forming substrate can vary considerably depending upon the puffing behaviour of a user. As a result, the composition and hence the sensory properties of the mainstream aerosol generated by such known heated smoking articles may disadvantageously be highly sensitive to a user's puffing regime.

In addition, in known heated smoking articles comprising one or more airflow channels along the combustible heat source, direct contact between air drawn through the one or more airflow channels and the combustible heat source during puffing by a user results in activation of combustion of the combustible heat source. As used herein, the term 'direct contact' is used to describe contact between air drawn through the one or more airflow channels and a surface of the combustible heat source. Intense puffing regimes may therefore lead to sufficiently high forced convective heat transfer to cause spikes in the temperature of the aerosol-forming substrate, disadvantageously leading to pyrolysis and potentially even localised combustion of the aerosol-forming substrate. As used herein, the term 'spike' is used to describe a short-lived increase in the temperature of the aerosol-forming substrate. As a result, the levels of undesirable pyrolytic and combustion by-products in the mainstream aerosols generated by such known heated smoking articles may also disadvantageously vary significantly depending upon the particular puffing regime adopted by a user.

It is known to include additives in the combustible heat sources of heated smoking articles in order to improve the ignition and combustion properties of the combustible heat sources. However, the inclusion of ignition and combustion additives can give rise to decomposition and reaction products, which may disadvantageously enter air drawn through one or more airflow channels provided along the combustible heat source of such known heated smoking articles during use thereof.

WO-A1-2011/139730A1 discloses a smoking article 10 including a heat generation segment 35 located at the lighting end 14, a filter segment 65 located at the other end (mouth end 18) and an aerosol-generating segment 51 that is located in between these two segments near the lighting end. The heat generation segment 35 can incorporate a generally cylindrical carbonaceous heat source 40 circumscribed by insulation 42. The smoking article optionally can be air-diluted by providing appropriate perforations 81 in the vicinity of the mouth end 18. The cross-sectional area of the heat source 40 preferably makes up about 10 percent to about 35 percent, often about 15 percent to about 25 percent of the total cross-sectional area of the heat generation segment 35, while the cross-sectional area of the outer or circumscribing region (comprising the insulation 42 and relevant outer wrapping materials) makes up about 65 percent to about 90 percent, often about 75 percent to about 85 percent of the total cross-sectional area of the heat generation segment.

GB-A-2469850 discloses a device for delivering volatilized material to a user in the form a simulated cigarette, which includes a reusable heat delivery component 11, and a volatilization component 20 which is usable only once and is intended to be disposed of after use. The heat delivery component 11 includes a cylindrical housing 12 having a flared end 34 arranged to detachably receive the volatilization component 20. A heat transfer device, in the form of a heat pipe 16, is disposed within the housing 12, and is surrounded by a supporting and insulating material 26. The heat pipe 16 extends longitudinally into a heat sink 14 at an end distal from the user's mouth, and at an opposed end 32 proximal to the user's mouth extends into the volatilization component 20. A plurality of perforations 18 are formed in the housing 12, which allow airflow into the supporting and insulating material 26. The device does not comprise a combustible heat source. Instead, the heat sink collects and retains heat that is supplied from an outside source and is preferably a metal or ceramic material, such as a honeycomb ceramic, aluminium, or may utilise an encapsulated or closed cell structure containing a phase change material.

There remains a need for heated smoking articles comprising a combustible heat source with opposed front and rear faces and an aerosol-forming substrate downstream of the rear face of the combustible heat source in which spikes in the temperature of the aerosol-forming substrate are avoided under intense puffing regimes. In particular, there remains a need for heated smoking articles comprising a combustible heat source with opposed front and rear faces and an aerosol-forming substrate downstream of the rear face of the combustible heat source in which substantially no combustion or pyrolysis of the aerosol-forming substrate occurs under intense puffing regimes.

According to the invention, there is provided a smoking article comprising: a blind combustible heat source having opposed front and rear faces wherein the blind combustible heat source has a transverse cross sectional area of at least about 60 percent of the transverse cross-sectional area of the smoking article; an aerosol-forming substrate downstream of the rear face of the blind combustible heat source, wherein the rear face of the blind combustible heat source and the aerosol-forming substrate are exposed to one another; a mouthpiece downstream of the aerosol-forming substrate; and one or more air inlets located downstream of the rear face of the blind combustible heat source and upstream of the mouthpiece. The one or more air inlets are located between the rear face of the blind combustible heat source and a downstream end of the aerosol-forming substrate and comprise one or more first air inlets around the periphery of the aerosol-forming substrate, and, in use, air drawn through the aerosol-forming substrate enters the smoking article through the one or more air inlets.

As used herein, the term 'blind' is used to describe a combustible heat source that does not include any airflow channels. As used herein, the term 'airflow channel' is used to describe a channel extending along the length of a blind combustible heat source through which air may be drawn downstream for inhalation by a user.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be in the form of a plug or segment comprising a material capable of releasing upon heating volatile compounds, which can form an aerosol, circumscribed by a wrapper. Where an aerosol-forming substrate is in the form of such a plug or segment, the entire plug or segment including the wrapper is considered to be the aerosol-forming substrate.

As used herein, the terms 'distal', 'upstream' and 'front', and 'proximal', 'downstream' and 'rear', are used to describe the relative positions of components, or portions of components, of the smoking article in relation to the direction in which a user draws on the smoking article during use thereof. Smoking articles according to the invention comprise a proximal end through which, in use, an aerosol exits the smoking article for delivery to a user. The proximal end of the smoking article may also be referred to as the mouth end. In use, a user draws on the proximal end of the smoking article in order to inhale an aerosol generated by the smoking article.

The blind combustible heat source is located at or proximate to the distal end. The mouthpiece is located at the proximal end. The mouth end is downstream of the distal end. The proximal end may also be referred to as the downstream end of the smoking article and the distal end may also be referred to as upstream end of the smoking article. Components, or portions of components, of smoking articles according to the invention may be described as being upstream or downstream of one another based on their relative positions between the proximal end and the distal end of the smoking article.

The front face of the blind combustible heat source is at the upstream end of the blind combustible heat source. The upstream end of the blind combustible heat source is the end of the blind combustible heat source furthest from the proximal end of the smoking article. The rear face of the blind combustible heat source is at the downstream end of the blind combustible heat source. The downstream end of the blind combustible heat source is the end of the blind combustible heat source closest to the proximal end of the smoking article.

As used herein, the term 'length' is used to describe the maximum dimension in the longitudinal direction of the smoking article. That is, the maximum dimension in the direction between the proximal end and the opposed distal end of the smoking article.

As used herein, the term 'transverse' is used to describe the direction perpendicular to the longitudinal direction. That is, the direction perpendicular to the direction between the proximal end and the opposed distal end of the smoking article.

As used herein, the term 'diameter' is used to describe the maximum dimension in the transverse direction of the smoking article.

As used herein, the term 'exposed' is used to describe components, or portions of components, of the smoking article that are in gaseous communication. That is, components, or portions of components, of the smoking article that are not physically separated by a gas-impermeable or substantially gas-impermeable barrier.

As used herein 'in gaseous communication' is used to describe components, or portions of components, of the smoking article that are arranged and configured to allow gas to move freely between them.

In smoking articles according to the invention, the rear face of the blind combustible heat source and the aerosol-forming substrate are exposed to one another. This means that there are no gas-impermeable or substantially gas-impermeable barriers between the rear face of the blind combustible heat source and the aerosol-forming substrate that prevent gaseous communication between the rear face of the blind combustible heat source and the aerosol-forming substrate.

The blind combustible heat source has a transverse cross sectional area of at least about 60 percent of the transverse cross-sectional area of the smoking article. Preferably, the blind combustible heat source has a transverse cross sectional area of at least about 90 percent of the transverse cross-sectional area of the smoking article.

In certain embodiments, the blind combustible heat source has a transverse cross sectional area of between about 60 percent and about 99 percent of the transverse cross-sectional area of the smoking article. In certain preferred embodiments the blind combustible heat source has a transverse cross sectional area of between about 90 percent and about 99 percent of the transverse cross-sectional area of the smoking article.

In certain particularly preferred embodiments the blind combustible heat source has a transverse cross sectional area of about 95 percent of the transverse cross-sectional area of the smoking article. For example, in certain embodiments the smoking article may have a diameter of about 8 mm and the blind combustible heat source may have a diameter of about 7.8 mm such that the transverse cross sectional area of the blind combustible heat source is about 95 percent of the transverse cross-sectional area of the smoking article.

Smoking articles according to the invention comprise one or more air inlets located downstream of the rear face of the blind combustible heat source and upstream of the mouthpiece. In use, air drawn through the aerosol-forming substrate of the smoking article enters the smoking article through the one or more air inlets.

As used herein, the term 'air inlet' is used to describe a hole, slit, slot or other aperture through which air may be drawn into the smoking article.

The one or more air inlets are located between the rear face of the blind combustible heat source and a downstream end of the aerosol-forming substrate. The one or more air inlets do not comprise any air inlets located between the downstream end of the aerosol-forming substrate and an upstream end of the mouthpiece. In other words, smoking articles according to the invention do not comprise any air inlets located downstream of the aerosol-forming substrate and upstream of the mouthpiece.

The number, shape, size and location of the air inlets may be appropriately adjusted to achieve a good smoking performance.

The one or more air inlets comprise one or more first air inlets around the periphery of the aerosol-forming substrate through which air may be drawn into the aerosol-forming substrate. In use, cool air is drawn into the aerosol-forming substrate of the smoking article through the first air inlets. The drawn air passes downstream through the smoking article from the aerosol-forming substrate to the mouthpiece and exits the smoking article through the proximal end thereof.

In certain preferred embodiments, the one or more first air inlets are located proximate to the downstream end of the aerosol-forming substrate.

In use, the air drawn through smoking articles according to the invention for inhalation by a user does not pass through any airflow channels along the blind combustible heat source. The lack of any airflow channels through the blind combustible heat source advantageously substantially prevents or inhibits activation of combustion of the blind combustible heat source of smoking articles according to the invention during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate of smoking articles according to the invention under intense puffing regimes may be advantageously avoided or inhibited. In addition, the impact of a user's puffing regime on the composition of the mainstream aerosol of smoking articles according to the invention may be advantageously minimised or reduced.

The inclusion of a blind combustible heat source also advantageously substantially prevents or inhibits combustion and decomposition products and other materials formed during ignition and combustion of the blind combustible heat source from entering air drawn through smoking articles according to the invention during use thereof. As described further below, this is particularly advantageous where the blind combustible heat source comprises one or more additives to aid ignition or combustion of the blind combustible heat source.

In smoking articles according to the invention, heat transfer from the blind combustible heat source to the aerosol-forming substrate occurs primarily by conduction and heating of the aerosol-forming substrate by forced convection is minimised or reduced. This advantageously helps to minimise or reduce the impact of a user's puffing regime on the composition of the mainstream aerosol of smoking articles according to the invention.

It will be appreciated that smoking articles according to the invention may comprise blind combustible heat sources comprising one or more closed or blocked passageways through which air may not be drawn for inhalation by a user.

For example, smoking articles according to the invention may comprise blind combustible heat sources comprising one or more closed passageways that extend from the front face at the upstream end of the blind combustible heat source only part way along the length of the blind combustible heat source.

The inclusion of one or more closed air passageways increases the surface area of the blind combustible heat source that is exposed to oxygen from the air and may advantageously facilitate ignition and sustained combustion of the blind combustible heat source.

During puffing by a user, cool air drawn through the one or more first air inlets around the periphery of the aerosol-forming substrate advantageously reduces the temperature of the aerosol-forming substrate of smoking articles according to the invention. This advantageously substantially prevents or inhibits spikes in the temperature of the aerosol-forming substrate of smoking articles according to the invention during puffing by a user.

As used herein, the term 'cool air' is used to describe ambient air that is not significantly heated by the blind combustible heat source upon puffing by a user.

By preventing or inhibiting spikes in the temperature of the aerosol-forming substrate, the inclusion of one or more first air inlets around the periphery of the aerosol-forming substrate, advantageously helps to avoid or reduce combustion or pyrolysis of the aerosol-forming substrate of smoking articles according to the invention under intense puffing regimes. In addition, the inclusion of one or more first air inlets around the periphery of the aerosol-forming substrate advantageously helps to minimise or reduce the impact of a user's puffing regime on the composition of the mainstream aerosol of smoking articles according to the invention.

In certain embodiments, the aerosol-forming substrate may abut the rear face of the blind combustible heat source. In use, this may advantageously improve conductive heat transfer between the rear face of the blind combustible heat source and the aerosol-forming substrate.

In other embodiments, the aerosol-forming substrate may be spaced apart from the rear face of the blind combustible heat source. That is, there may be a space or gap between the aerosol-forming substrate and the rear face of the blind combustible heat source.

In such embodiments, the one or more air inlets may further comprise one or more second air inlets between the rear face of the blind combustible heat source and the aerosol-forming substrate. In use, cool air is drawn into the aerosol-forming substrate of the smoking article through the first air inlets and cool air is drawn into the space between the blind combustible heat source and the aerosol-forming substrate through the second air inlets. The drawn air passes downstream through the smoking article from the aerosol-forming substrate to the mouthpiece and exits the smoking article through the proximal end thereof.

Preferably, smoking articles according to the invention comprise an outer wrapper that circumscribes the aerosol-forming substrate and at least a rear portion of the blind combustible heat source. The outer wrapper should grip the blind combustible heat source and the aerosol-forming substrate of the smoking article when the smoking article is assembled.

More preferably, smoking articles according to the invention comprise an outer wrapper that circumscribes the mouthpiece, the aerosol-forming substrate, any other components of the smoking article downstream of the aerosol-forming substrate and upstream of the mouthpiece, and at least a rear portion of the blind combustible heat source.

Preferably, the outer wrapper is substantially air impermeable.

Smoking articles according to the invention may comprise outer wrappers formed from any suitable material or combination of materials. Suitable materials are well known in the art and include, but are not limited to, cigarette paper.

The one or more air inlets located between the rear face of the blind combustible heat source and the downstream end of the aerosol-forming substrate are provided in the outer wrapper and any other materials circumscribing components of smoking articles according to the invention through which air may be drawn into the smoking article.

The one or more first air inlets around the periphery of the aerosol-forming substrate are provided in the outer wrapper and any other materials circumscribing the aerosol-forming substrate.

Preferably, the blind combustible heat source is a carbonaceous heat source. As used herein, the term 'carbonaceous' is used to describe a blind combustible heat source comprising carbon. Preferably, combustible carbonaceous heat sources for use in smoking articles according to the invention have a carbon content of at least about 35 percent, more preferably of at least about 40 percent, most preferably of at least about 45 percent by dry weight of the blind combustible heat source.

In some embodiments, blind combustible heat sources according to the invention are combustible carbon-based heat sources. As used herein, the term 'carbon-based heat source' is used to describe a heat source comprised primarily of carbon.

Combustible carbon-based heat sources for use in smoking articles according to the invention have a carbon content of at least about 50 percent. For example, combustible carbon-based heat sources for use in smoking articles according to the invention may have a carbon content of at least about 60 percent, or at least about 70 percent, or at least about 80 percent by dry weight of the combustible carbon-based heat source.

Smoking articles according to the invention may comprise blind combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In one preferred embodiment, the blind combustible heat source is formed from a mixture of carbon powder, modified cellulose, flour and sugar.

Instead of, or in addition to one or more binders, blind combustible heat sources for use in smoking articles according to the invention may comprise one or more additives in order to improve the properties of the blind combustible heat source. Suitable additives include, but are not limited to, additives to promote consolidation of the blind combustible heat source (for example, sintering aids), additives to promote ignition of the blind combustible heat source (for example, oxidisers such as perchlorates, chlorates, nitrates, peroxides, permanganates, zirconium and combinations thereof), additives to promote combustion of the blind combustible heat source (for example, potassium and potassium salts, such as potassium citrate) and additives to promote decomposition of one or more gases produced by combustion of the blind combustible heat source (for example catalysts, such as CuO, $Fe_2O_3$ and $Al_2O_3$).

In certain preferred embodiments, the blind combustible heat source is a blind combustible carbonaceous heat source comprising carbon and at least one ignition aid. In one preferred embodiment, the blind combustible heat source is a combustible carbonaceous heat source comprising carbon and at least one ignition aid as described in WO-A1-2012/164077.

As used herein, the term 'ignition aid' is used to denote a material that releases one or both of energy and oxygen during ignition of the blind combustible heat source, where the rate of release of one or both of energy and oxygen by the material is not ambient oxygen diffusion limited. In other words, the rate of release of one or both of energy and oxygen by the material during ignition of the blind combustible heat source is largely independent of the rate at which ambient oxygen can reach the material. As used herein, the term 'ignition aid' is also used to denote an elemental metal that releases energy during ignition of the blind combustible heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the blind combustible heat source, such alkali metal burn salts do not release enough energy during ignition of a blind combustible heat source to produce an acceptable aerosol during early puffs.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulphates; sulfites; other sulfoxides; phosphates; phospinates; phosphites; and phosphanites.

While advantageously improving the ignition and combustion properties of the blind combustible heat source, the inclusion of ignition and combustion additives can give rise to undesirable decomposition and reaction products during use of the smoking article. For example, decomposition of nitrates included in the blind combustible heat source to aid ignition thereof can result in the formation of nitrogen oxides. The inclusion of a blind combustible heat source in smoking articles according to the invention advantageously substantially prevents or inhibits such decomposition and reaction products from entering air drawn through smoking articles according to the invention during use thereof.

Blind combustible carbonaceous heat sources for use in smoking articles according to the invention may be prepared as described in prior art that is known to persons of ordinary skill in the art.

Blind combustible carbonaceous heat sources for use in smoking articles according to the invention, are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction or pressing. In certain preferred embodiments, the mixture is pre-formed into a desired shape by pressing or extrusion or a combination thereof.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, particularly after extrusion, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. The elongate rod or other desired shape is pyrolysed preferably in a nitrogen atmosphere at a temperature of between about 700° C. and about 900° C.

In certain embodiments, at least one metal nitrate salt is incorporated in the blind combustible heat source by including at least one metal nitrate precursor in the mixture of one or more carbon containing materials, one or more binders and other additives. The at least one metal nitrate precursor is then subsequently converted in-situ into at least one metal nitrate salt by treating the pyrolysed pre-formed cylindrical rod or other shape with an aqueous solution of nitric acid. In one embodiment, the blind combustible heat source comprises at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In preferred embodiments, exposure of the blind combustible heat source to a conventional yellow flame lighter or other ignition means should cause the at least one metal nitrate salt to decompose and release oxygen and energy. This decomposition causes an initial boost in the temperature of the blind combustible heat source and also aids in the ignition of the blind combustible heat source. After decomposition of the at least one metal nitrate salt, the blind combustible heat source preferably continues to combust at a lower temperature.

The inclusion of at least one metal nitrate salt advantageously results in ignition of the blind combustible heat source being initiated internally, and not only at a point on the surface thereof. Preferably, the at least one metal nitrate salt is present in the blind combustible heat source in an amount of between about 20 percent by dry weight and about 50 percent by dry weight of the blind combustible heat source.

In other embodiments, the blind combustible heat source comprises at least one peroxide or superoxide that actively evolves oxygen at a temperature of less than about 600° C., more preferably at a temperature of less than about 400° C. Preferably, the at least one peroxide or superoxide actively evolves oxygen at a temperature of between about 150° C. and about 600° C., more preferably at a temperature of between about 200° C. and about 400° C., most preferably at a temperature of about 350° C.

In use, exposure of the blind combustible heat source to a conventional yellow flame lighter or other ignition means should cause the at least one peroxide or superoxide to decompose and release oxygen. This causes an initial boost in the temperature of the blind combustible heat source and also aids in the ignition of the blind combustible heat source. After decomposition of the at least one peroxide or superoxide, the blind combustible heat source preferably continues to combust at a lower temperature.

The inclusion of at least one peroxide or superoxide advantageously results in ignition of the blind combustible heat source being initiated internally, and not only at a point on the surface thereof.

The blind combustible heat source preferably has a porosity of between about 20 percent and about 80 percent, more preferably of between about 20 percent and 60 percent. Where the blind combustible heat source comprises at least one metal nitrate salt, this advantageously allows oxygen to diffuse into the mass of the blind combustible heat source at a rate sufficient to sustain combustion as the at least one metal nitrate salt decomposes and combustion proceeds. Even more preferably, the blind combustible heat source has a porosity of between about 50 percent and about 70 percent, more preferably of between about 50 percent and about 60 percent as measured by, for example, mercury porosimetry or helium pycnometry. The required porosity may be readily achieved during production of the blind combustible heat source using conventional methods and technology.

Advantageously, blind combustible carbonaceous heat sources for use in smoking articles according to the invention have an apparent density of between about 0.6 $g/cm^3$ and about 1 $g/cm^3$.

Preferably, the blind combustible heat source has a mass of between about 300 mg and about 500 mg, more preferably of between about 400 mg and about 450 mg.

Preferably, the blind combustible heat source has a length of between about 7 mm and about 17 mm, more preferably of between about 7 mm and about 15 mm, most preferably of between about 7 mm and about 13 mm.

Preferably, the blind combustible heat source has a diameter of between about 5 mm and about 9 mm, more preferably of between about 7 mm and about 8 mm.

Preferably, the blind combustible heat source is of substantially uniform diameter. However, the blind combustible heat source may alternatively be tapered so that the diameter of a rear portion of the blind combustible heat source is greater than the diameter of a front portion thereof. In such embodiments, the rear portion of the blind combustible heat source has a transverse cross sectional area of at least about 60 percent of the transverse cross-sectional area of the smoking article.

Particularly preferred are blind combustible heat sources that are substantially cylindrical. The blind combustible heat source may, for example, be a cylinder or tapered cylinder of substantially circular cross-section or a cylinder or tapered cylinder of substantially elliptical cross-section.

Smoking articles according to the invention preferably comprise an aerosol-forming substrate comprising at least one aerosol-former and a material capable of releasing volatile compounds in response to heating. The aerosol-forming substrate may comprise other additives and ingredients including, but not limited to, humectants, flavourants, binders and mixtures thereof.

Preferably, the aerosol-forming substrate comprises nicotine. More preferably, the aerosol-forming substrate comprises tobacco.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon.

Preferably, the material capable of emitting volatile compounds in response to heating is a charge of tobacco-based material, most preferably a charge of homogenised tobacco-based material.

The aerosol-forming substrate may be in the form of a plug or segment comprising a material capable of emitting volatile compounds in response to heating circumscribed by a paper or other wrapper. As stated above, where an aerosol-forming substrate is in the form of such a plug or segment, the entire plug or segment including any wrapper is considered to be the aerosol-forming substrate.

Preferably, the aerosol-forming substrate has a length of between about 5 mm and about 20 mm, more preferably of between about 8 mm and about 12 mm.

In preferred embodiments, the aerosol-forming substrate comprises a plug of tobacco-based material wrapped in a plug wrap. In particular preferred embodiments, the aerosol-forming substrate comprises a plug of homogenised tobacco-based material wrapped in a plug wrap.

Preferably, smoking articles according to the invention further comprise a heat-conducting element around a rear portion of the blind combustible heat source and at least a front portion of the aerosol-forming substrate. The heat-conducting element is preferably combustion resistant. In certain embodiments, the heat conducting element is oxygen restricting. In other words, the heat-conducting element inhibits or resists the passage of oxygen through the heat-conducting element to the combustible heat source.

In certain embodiments, the heat-conducting element may be in direct contact with both the rear portion of the blind combustible heat source and the aerosol-forming substrate. In such embodiments, the heat-conducting element provides a thermal link between the blind combustible heat source and the aerosol-forming substrate of smoking articles according to the invention.

In other embodiments, the heat-conducting element may be spaced apart from one or both of the rear portion of the blind combustible heat source and the aerosol-forming substrate, such that there is no direct contact between the heat-conducting element and one or both of the rear portion of the blind combustible heat source and the aerosol-forming substrate.

Suitable heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers.

Preferably, the rear portion of the blind combustible heat source surrounded by the heat-conducting element is between about 2 mm and about 8 mm in length, more preferably between about 3 mm and about 5 mm in length.

Preferably, the front portion of the blind combustible heat source not surrounded by the heat-conducting element is between about 4 mm and about 15 mm in length, more preferably between about 5 mm and about 8 mm in length.

In certain embodiments, the entire length of the aerosol-forming substrate may be surrounded by the heat-conducting element.

In other embodiments, the heat-conducting element may surround only a front portion of the aerosol-forming substrate. In such embodiments, the aerosol-forming substrate extends downstream beyond the heat-conducting element.

In embodiments in which the heat-conducting element surrounds only a front portion of the aerosol-forming substrate, the aerosol-forming substrate preferably extends at least about 3 mm downstream beyond the heat-conducting element. More preferably, the aerosol-forming substrate extends between about 3 mm and about 10 mm downstream beyond the heat-conducting element. However, the aerosol-forming substrate may extend less than 3 mm downstream beyond the heat-conducting element.

Preferably, the front portion of the aerosol-forming substrate surrounded by the heat-conducting element is between about 1 mm and about 10 mm in length, more preferably between about 2 mm and about 8 mm in length, most preferably between about 2 mm and about 6 mm in length.

Smoking articles according to the invention comprise a mouthpiece downstream of the aerosol-forming substrate.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Smoking articles according to the element preferably further comprise a transfer element or spacer element between the aerosol-forming substrate and the mouthpiece.

The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the blind combustible heat source to the aerosol-forming substrate. The inclusion of a transfer element also advantageously allows the overall length of smoking articles according to the invention to be adjusted to a desired value, for example to a length similar to that of conventional cigarettes, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the smoking article, and the presence and length of other components within the smoking article.

Preferably, the transfer element comprises at least one open-ended tubular hollow body. In such embodiments, in use, the air drawn into the smoking article through the one or more air inlets passes through the at least one open-ended tubular hollow body as it passes downstream through the smoking article from the aerosol-forming substrate to the mouthpiece.

The transfer element may comprise at least one open-ended tubular hollow body formed from one or more suitable materials that are substantially thermally stable at the temperature of the aerosol generated by the transfer of heat from the blind combustible heat source to the aerosol-forming substrate. Suitable materials are known in the art and include, but are not limited to, paper, cardboard, plastics, such a cellulose acetate, ceramics and combinations thereof.

Alternatively or in addition, smoking articles according to the invention may comprise an aerosol-cooling element or heat exchanger between the aerosol-forming substrate and the mouthpiece. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Smoking articles according to the invention may comprise one or more aerosol modifying agents downstream of the aerosol-forming substrate. For example, one or more of the mouthpiece, transfer element and aerosol-cooling element of smoking articles according to the invention may comprise one or more aerosol modifying agents.

Suitable aerosol-modifying agents include, but are not limited to: flavourants; and chemesthetic agents.

As used herein, the term 'flavourant' is used to describe any agent that, in use, imparts one or both of a taste or aroma to an aerosol generated by the aerosol-forming substrate of the smoking article.

As used herein, the term 'chemesthetic agent' is used to describe any agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

Smoking articles according to the invention may comprise one or more aerosol modifying agents that are both a flavourant and a chemesthetic agent downstream of the aerosol-forming substrate. For example, one or more of the mouthpiece, transfer element and aerosol-cooling element of smoking articles according to the invention may comprise menthol or another flavourant that provides a cooling chemesthetic effect.

Smoking articles according to the invention may be assembled using known methods and machinery.

Figure 2:
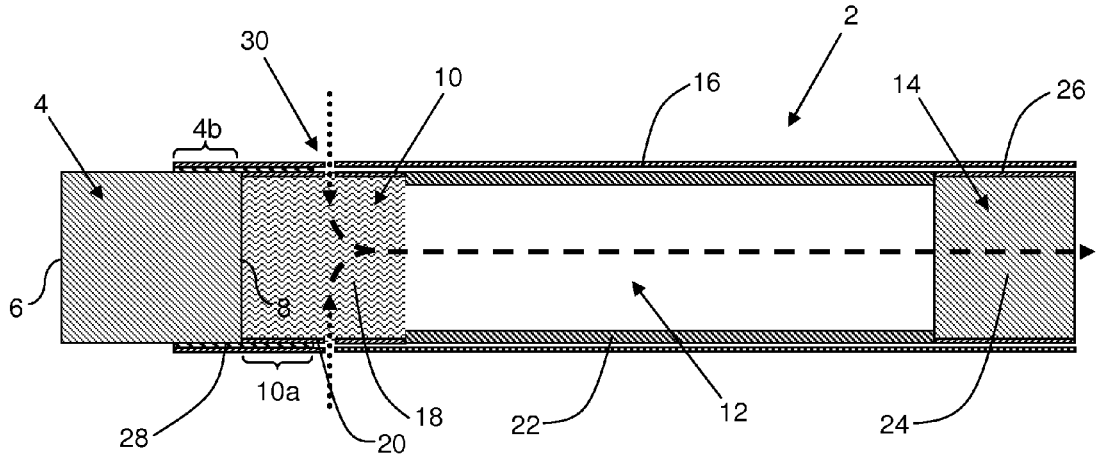
Figure 3:
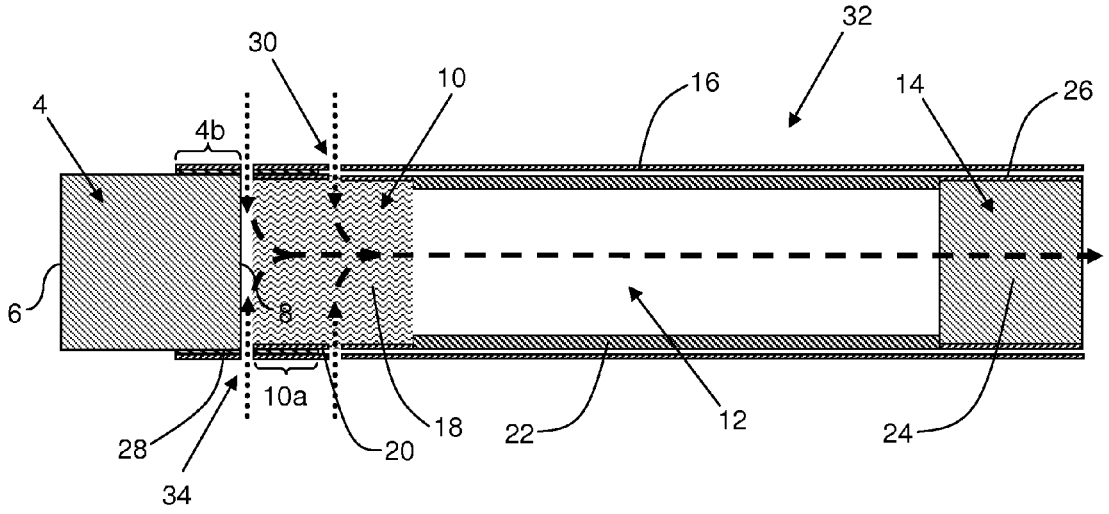

The invention will be further described, by way of example only, with reference to the accompanying drawings in which:

FIG. 1*a*) shows an exploded view of a smoking article according to a first embodiment of the invention;

FIG. 1*b*) shows an exploded view of a smoking article according to a second embodiment of the invention;

FIG. 2 shows a schematic longitudinal cross-section of the smoking article according to the first embodiment of the invention shown in FIG. 1*a*); and FIG. 3 shows a schematic longitudinal cross-section of a smoking article according to the second embodiment of the invention shown in FIG. 1*b*).

The smoking article 2 according to the first embodiment of the invention shown in FIGS. 1*a*) and 2 comprises a blind combustible heat source 4 having a front face 6 and an opposed rear face 8, an aerosol-forming substrate 10, a transfer element 12 and a mouthpiece 14 in abutting coaxial alignment. As shown in FIG. 2, the aerosol-forming substrate 10, transfer element 12 and mouthpiece 14 and a rear portion of the blind combustible heat source 4 are wrapped in an outer wrapper 16 of sheet material such as, for example, cigarette paper, of low air permeability.

The blind combustible heat source 4 is a blind carbonaceous blind combustible heat source and is located at the distal end of the smoking article 2.

The aerosol-forming substrate 10 is located immediately downstream of the rear face 8 of the blind combustible heat source 4 and is exposed to the rear face 8 of the blind combustible heat source. The aerosol-forming substrate 10 comprises a cylindrical plug of homogenised tobacco-based material 18 including an aerosol former such as, for example, glycerine, wrapped in plug wrap 20.

The transfer element 12 is located immediately downstream of the aerosol-forming substrate 10 and comprises a cylindrical open-ended hollow tube 22 of suitable material such as, for example, paper, cardboard or cellulose acetate tow.

The mouthpiece 14 is located immediately downstream of the transfer element 12 at the proximal end of the smoking article 2. The mouthpiece 14 comprises a cylindrical plug of suitable filtration material 24 such as, for example, cellulose acetate tow of very low filtration efficiency, wrapped in filter plug wrap 26.

The smoking article may further comprise a band of tipping paper (not shown) circumscribing a downstream end portion of the outer wrapper 16.

As shown in FIG. 2, the smoking article 2 further comprises a heat-conducting element 28 of suitable material such as, for example, aluminium foil, around and in contact with a rear portion 4*b* of the blind combustible heat source 4 and an abutting front portion 10*a* of the aerosol-forming substrate 10. In the smoking article 2 according to the first embodiment of the invention shown in FIG. 2, the aerosol-forming substrate 10 extends downstream beyond the heat-conducting element 28. That is, the heat-conducting element 28 is not around and in contact with a rear portion of the aerosol-forming substrate 10. However, it will be appreciated that in other embodiments of the invention (not shown), the heat-conducting element 28 may be around and in contact with the entire length of the aerosol-forming substrate 10.

The smoking article 2 according to the first embodiment of the invention comprises one or more air inlets located downstream of the rear face 8 of the blind combustible heat source 4 and upstream of the mouthpiece 14. The one or more air inlets are located between the rear face 8 of the blind combustible heat source 4 and a downstream end of the aerosol-forming substrate 10 and comprise one or more first air inlets 30 located around the periphery of the aerosol-forming substrate 10.

As shown in FIG. 2, a circumferential arrangement of first air inlets 30 is provided in the plug wrap 20 of the aerosol-forming substrate 10 and the overlying outer wrapper 16 to admit cool air (shown by dotted arrows in FIGS. 1*a*) and 2) into the aerosol-forming substrate 10. It will be appreciated that in other embodiments of the invention (not shown) in which the heat-conducting element 28 is around and in contact with the entire length of the aerosol-forming substrate 10, a circumferential arrangement of first air inlets 30 may be provided in the plug wrap 20 of the aerosol-forming substrate 10, the overlying heat-conducting element 28 and the overlying outer wrapper 16 to admit cool air into the aerosol-forming substrate 10.

In use, a user ignites the blind combustible heat source 4 of the smoking article 2 according to the first embodiment of the invention and then draws on the mouthpiece 14. When a user draws on the mouthpiece 14, cool air (shown by dotted arrows in FIGS. 1*a*) and 2) is drawn into the aerosol-forming substrate 10 of the smoking article 2 through the first air inlets 30.

The front portion 10*a* of the aerosol-forming substrate 10 is heated by conduction through the abutting rear face 8 of the blind combustible heat source 4 and the heat-conducting element 28.

The heating of the aerosol-forming substrate 10 by conduction releases glycerine and other volatile and semi-volatile compounds from the plug of homogenised tobacco-based material 18. The compounds released from the aerosol-forming substrate 10 form an aerosol that is entrained in the air drawn into the aerosol-forming substrate 10 of the smoking article 2 through the first air inlets 30 as it flows through the aerosol-forming substrate 10. The drawn air and entrained aerosol (shown by dashed arrows in FIGS. 1*a*) and 2) pass downstream through the transfer element 12, where they cool and condense. The cooled drawn air and entrained aerosol pass downstream through the mouthpiece 14 and are delivered to the user through the proximal end of the smoking article 2 according to the first embodiment of the invention.

The smoking article 32 according to the second embodiment of the invention shown in FIGS. 1*b*) and 3 is of largely identical construction to the smoking article according to the first embodiment of the invention shown in FIGS. 1*a*) and 2. However, in the smoking article 32 according to the second embodiment of the invention the blind combustible heat source 4 and the aerosol-forming substrate 10 are spaced apart from one another.

As shown in FIG. 3, in addition to a circumferential arrangement of first air inlets 30 around the periphery of the aerosol-forming substrate 10, in the smoking article 32 according to the second embodiment of the invention a circumferential arrangement of second air inlets 34 is provided in the heat-conducting element 28 and the overlying outer wrapper 16 between the rear face 8 of the blind combustible heat source 4 and the upstream end of the aerosol-forming substrate 10 to admit cool air (shown by dotted arrows in FIGS. 1*b*) and 3) into the space between the blind combustible heat source 4 and the aerosol-forming substrate 10.

In use when a user draws on the mouthpiece 14 of the smoking article 32 according to the second embodiment of the invention, cool air (shown by dotted arrows in FIGS. 1*b*) and 3) is drawn into the aerosol-forming substrate 10 of the smoking article 2 through the first air inlets 30 and also into the space between the blind combustible heat source 4 and the aerosol-forming substrate 10 through the second air inlets 34.

The front portion 10*a* of the aerosol-forming substrate 10 is heated primarily by conduction through the heat-conducting element 28.

The heating of the aerosol-forming substrate 10 by conduction releases glycerine and other volatile and semi-volatile compounds from the plug of homogenised tobacco-based material 18. The compounds released from the aerosol-forming substrate 10 form an aerosol that is entrained in the air drawn into the aerosol-forming substrate 10 of the smoking article 2 through the first air inlets 30 and the air drawn into the space between the blind combustible heat source 4 and the aerosol-forming substrate 10 through the second air inlets 34 as it flows through the aerosol-forming substrate 10. The drawn air and entrained aerosol (shown by dashed arrows in FIGS. 1*a*) and 2) pass downstream through the transfer element 12, where they cool and condense. The cooled drawn air and entrained aerosol pass downstream through the mouthpiece 14 and are delivered to the user through the proximal end of the smoking article 2 according to the first embodiment of the invention.

In use, when a user draws on the mouthpiece 14 of the smoking articles 2, 32 according to the first and second embodiments of the invention, no air is drawn through the blind combustible heat source 4 thereof. Consequently, as described above, the aerosol-forming substrate 10 of the smoking article 2 according to the first embodiment of the invention is heated exclusively by conduction through the abutting rear face 8 of the blind combustible heat source 4 and the heat-conducting element 28 and the aerosol-forming substrate 10 of the smoking article 32 according to the second embodiment of the invention is heated primarily by conduction through the heat-conducting element 28.

In use, the cool air drawn into the one or more first air inlets around the periphery of the aerosol-forming substrate 10 reduces the temperature of the aerosol-forming substrate 10 of the smoking articles 2, 32 according to the first and second embodiments of the invention during puffing by a user.

In combination, the inclusion in the smoking articles 2, 32 according to the first and second embodiments of the invention of a blind combustible heat source 4 and one or more first air inlets 30 around the periphery of the aerosol-forming substrate 120 advantageously prevents or inhibits spikes in the temperature of the aerosol-forming substrate 10 during puffing by a user and advantageously minimises or reduces the impact of a user's puffing regime on the composition of the mainstream aerosol of the smoking articles 2, 32 according to the first and second embodiments of the invention.

The specific embodiments described above are intended to illustrate the invention.

However, other embodiments may be made without departing from the spirit and scope of the invention as defined in the claims, and it is to be understood that the specific embodiments described above are not intended to be limiting.

The invention claimed is:

1. A smoking article, comprising:

a blind combustible heat source having opposed front and rear faces and having a transverse cross sectional area of at least about 60 percent of a transverse cross-sectional area of the smoking article;

an aerosol-forming substrate downstream of the rear face of the blind combustible heat source, wherein the rear face and the aerosol-forming substrate are exposed to one another and the aerosol-forming substrate abuts the rear face of the blind combustible heat source;

a mouthpiece downstream of the aerosol-forming substrate; and one or more air inlets located downstream of the rear face of the blind combustible heat source and upstream of the mouthpiece, wherein the one or more air inlets are located between the rear face and a downstream end of the aerosol-forming substrate and comprise one or more first air inlets around a periphery of the aerosol-forming substrate, wherein the smoking article does not include any air inlets located downstream of the aerosol-forming substrate and located upstream of the mouthpiece other than the one or more air inlets, and wherein the smoking article is configured such that air drawn through the aerosol-forming substrate enters the smoking article through the one or more air inlets.

2. The smoking article according to claim 1, wherein the blind combustible heat source has a transverse cross sectional area of between about 60 percent and about 99 percent of the transverse cross-sectional area of the smoking article.

3. The smoking article according to claim 1, wherein the blind combustible heat source has a transverse cross sectional area of between about 90 percent and about 99 percent of the transverse cross-sectional area of the smoking article.

4. The smoking article according to claim 1, further comprising an outer wrapper circumscribing the aerosol-forming substrate and at least a rear portion of the blind combustible heat source.

5. The smoking article according to claim 1, further comprising:

a heat-conducting element around a rear portion of the blind combustible heat source and at least a front portion of the aerosol-forming substrate.

6. The smoking article according to claim 1, wherein the aerosol-forming substrate comprises a tobacco-based material and at least one aerosol former.

7. The smoking article according to claim 1, wherein the blind combustible heat source is a combustible carbonaceous heat source.

8. The smoking article according to claim 1, wherein the blind combustible heat source comprises an ignition aid.

9. The smoking article according to claim 8, wherein the ignition aid is an oxidizing agent.

10. The smoking article according to claim 1, further comprising:

a transfer element between the aerosol-forming substrate and the mouthpiece.

11. The smoking article according to claim 10, wherein the transfer element comprises an open-ended hollow tubular body.

12. The smoking article according to claim 1, further comprising one or more aerosol modifying agents downstream of the aerosol-forming substrate.

* * * * *